United States Patent [19]

Ressel

[11] Patent Number: 4,559,748

[45] Date of Patent: Dec. 24, 1985

[54] PRE-FORMED BUILDING SYSTEMS

[76] Inventor: Dennis E. Ressel, P.O. Box 5, Upland, Calif. 91786

[21] Appl. No.: 435,877

[22] Filed: Jan. 28, 1983

[51] Int. Cl.[4] ..... E04B 7/02

[52] U.S. Cl. ..... 52/90; 52/93; 52/262

[58] Field of Search ..... 52/90, 92, 94, 262, 52/263, 639, 643, 94, 404, 407, 580, 807

[56] References Cited

U.S. PATENT DOCUMENTS

| | | | |
|---|---|---|---|
| 2,836,266 | 5/1958 | Leeser | 52/404 |
| 3,137,098 | 6/1964 | Elia et al. | 52/639 |
| 3,157,251 | 11/1964 | Rasch | 52/263 |
| 4,012,882 | 3/1977 | Suriss et al. | 52/807 |
| 4,161,089 | 7/1979 | Omansky | 52/262 |
| 4,165,591 | 8/1979 | Fitzgibbon | 52/90 |
| 4,167,838 | 9/1979 | Metheny | 52/90 |
| 4,285,184 | 8/1981 | Turner, Jr. | 52/404 |
| 4,307,548 | 12/1981 | Nelson | 52/90 |
| 4,310,992 | 1/1982 | Thabet | 52/262 |
| 4,376,362 | 3/1983 | Jackson | 52/90 |

FOREIGN PATENT DOCUMENTS

| | | | |
|---|---|---|---|
| 21098 | 3/1920 | France | 52/643 |
| 2049755 | 12/1980 | United Kingdom | 52/92 |

*Primary Examiner*—John E. Murtagh
*Assistant Examiner*—Andrew Joseph Rudy
*Attorney, Agent, or Firm*—Robert K. Wallor

[57] ABSTRACT

A system of pre-formed panels, trusses, and roof elements, configured so as to affix to and integrate with one another to form a building structure. The truss elements are independently supported by columns. The several wall panel frames are attached to said support columns, to each other, and to the foundation of the structure. The roof panel frames are attached to the walls, to the trusses, and to each other. The entirety forms an integrated structure of substantial strength.

Each wall panel frame is pre-formed so as to, after erection of the structure frame, receive exterior sheeting, in half-standard sheet sizes, within its outer frame, said sheeting being rigidly affixed to said panel frame. Similarly, interior sheeting is affixed to the inner side of the said panel frame, and insulation may be introduced between the two sheets. Exterior sheeting is similarly affixed to the roof panel frames, which is subsequently overlaid with standard roofing materials.

9 Claims, 11 Drawing Figures

PRE-FORMED BUILDING SYSTEMS

BACKGROUND OF THE INVENTION

Readily erectable economic building systems and elements thereof of a wide variety have been known to the prior art. However, many of such systems have met with resistance, in use, from local governmental agencies when permanent structures are desired. The herein system provides improved structural integrity for the finished structure and presents an aesthetically pleasing appearance. Both features are acceptable under present building codes for a variety of permanent or reusable temporary installations.

Several advantages are evidenced in the herein described system. The costs, when compared to either standard construction or "tilt-up", are quite favorable in the use of pre-fabricated standard sections. Construction time is significantly reduced. Transport of the standard panels and truss members is facilitated by their relatively small component sizes, so that special load clearances are not required. Buildings of various sizes, as will be set forth below, can be assembled from combinations of the several standard components. Further economy is achieved by design of the several standard panel elements to accept exterior paneling in half sheet sizes in all but a few elements, thereby minimizing waste.

SUMMARY OF THE INVENTION

The present invention is directed to an improved system for the rapid, economic construction of permanent, temporary, and reusable structures, and to a manner of production of several component subassemblies forming such structures. As a further advantage, a wall assembly of the invention provides for using a foam material within inner and outer sheeting associated with the wall assembly to increase insulation values. As another inportant feature, the inner and outer sheeting is incorporated into the wall assembly as sheeting elements which are, in general, half or quarter sheets of standard sheeting to minimize waste. As yet a further important feature, several variant configurations of wall panel subassemblies are provided to accept door and window openings where desired on the exterior of the building.

In construction of a structure in accordance with the present invention, several wall, roof, and truss panel subassemblies are assembled together such that truss members, appropriately assembled from truss panel subassemblies, rest upon and are attached to separate support columns, wall panel subassemblies are attached to the support columns, to each other, to the foundation, and to roof panel subassemblies where appropriate, and roof panel subassemblies are attached to the truss members, to each other, and to the wall panel subassemblies where appropriate. No distinction is made between wall panel subassemblies intended for use in forming side walls of the structure and wall panel subassemblies intended for use in forming end walls of the structure. All such attachments are by bolt means, with the whole resulting in a structure of high strength and low cost. Additional insulation may be added to the interior wall between the support columns to achieve high insulation values with the added benefit of providing a uniform interior wall.

Each wall panel subassembly is pre-formed of rectangular tubing elements welded or otherwise rigidly affixed to each other to form a substantially rectangular wall panel frame divided by other rigidly affixed rectangular tubing elements into square or rectangular areas, each having inner dimensions commensurate with a nominal half-sheet dimensions of standard sheeting panels. As an example, if the building is desired to have exterior walls of approximately twelve feet in elevation, each wall panel frame will be divided by two horizontal elements to form three regions in the vertical direction, each encompassing slightly more than four feet clear spacing in elevation. The added fractional dimension is provided as an allowance for small irregularities in sheeting panels. Typically, each wall panel frame is also divided by a single vertical element to result in two clear regions in a horizontal direction, the separation between adjacent vertical elements defining a nominal first spacing distance, each having the inner clear horizontal dimension as provided in the vertical direction.

Within each such clear region are rigidly affixed smaller vertical elements separated uniformly, with one of such set located immediately adjacent to and affixed to each of the vertical sides and horizontal elements of said wall panel frame. Said vertical elements are predrilled in a direction perpendicular to the plane of the clear region to accept screw means for assembly of the exterior and interior sheeting.

Each such pre-assembled wall panel subassembly contains a plurality of pre-drilled holes in the outwardly exposed edge surfaces of the tubing elements forming the rectangular frame, such holes being disposed, in the plane of the frame, about its periphery, matching such holes in adjacent wall panel subassemblies, through which bolt means are installed on assembly of the structure.

Depending on the size of structure desired, said wall panel subassemblies are pre-formed into the nominal widths of four or eight feet by either eight, ten, twelve, fifteen, or sixteen feet in height. Such nominal dimensions are established to appropriately accept half sheets of commercially available four foot by eight foot or four foot by ten foot sheeting panels. Jigs for fabricating the several sizes are available but are not within the scope of this invention.

Roof panel subassemblies are similarly pre-formed into eight foot by either eight foot, four foot, or two foot panel frames.

Truss members are pre-formed to comprise two or three truss panel subassemblies. Two of such subassemblies, of a first type, are each nominally eight, twelve, or sixteen feet in length and are formed of rectangular tubing material. A lower horizontal rib element, of approximately the nominal length, serves as a support element for vertical riser elements located nominally every four feet. Vertical riser elements, in the longer truss panel subassemblies, are double elements at the eight foot distance from a first end in order to provide spacing to match the end wall panel subassembly widths. A diagonal rib element, welded to the first end of the lower horizontal rib element, rests upon and is affixed to the tops of the several vertical riser elements such that the truss panel subassembly assumes a triangular form. The riser elements have appropriate lengths to accommodate a desired roof slope angle. The diagonal rib element has an extent such that its horizontal projection matches the nominal length of the truss panel subassembly. Diagonal brace elements are incorporated into the design for structural strength.

Such triangular truss panel subassemblies of the first type are reversible as either right or left ends of an assembled truss member.

A central truss panel subassembly, or a truss panel subassembly of a second type, nominally of four, eight, or sixteen foot span, is formed of rectangular tubing elements appropriately rigidly connected into a frame having the shape of mirror image trapezoids having a common horizontal lower rib element, diagonal rib elements having slopes matching the triangular truss panel subassemblies, and vertical riser elements of such that, together with a left and a right end truss panel subassembly, the three truss panel subassemblies, two of the first type and one of the second type, may be united to form a dihedral truss member. Diagonal bracing is also incorporated into the central truss panel subassembly of the truss member.

When three such truss panel subassemblies are so assembled, a single truss member, having a span appropriate to the desired building width, is formed. Narrower structures, having a nominal span of thirty feet or less, may be formed by assembling a left and a right end truss panel subassembly of the first type together, omitting the central truss panel subassembly of the second type.

To accomplish assembly of a structure in accordance with the present invention, after preparation of a proper foundation by standard construction methods, including accurate placement of anchor bolts, support columns are erected and installed upon said foundation at nominally four foot increments (the first spacing distance) along a first row defining a length of the structure. A parallel row of similarly spaced apart support columns, separated from the first row by a nominal desired width of the structure, are erected on the foundation. At every eight foot length from a corner column, an abutting pair of columns forming a double column, in the direction of the row is installed for structural strength and also to provide for proper wall panel spacing. Each single or double support column has an appropriate saddle affixed to its upper end to receive a truss member. Truss members are installed and attached to the saddles bridging the width of the structure such that their ends rest solely on matching single or double columns.

Wall panel subassemblies are then bolted to the support columns, to the foundation, and to each other. It is to be noted that the vertical frame and major vertical divider elements of said wall panel frames align with the truss support columns such that a double column matches the double vertical frame element occuring where two side by side wall panel subassemblies abut.

Subsequently, roof panel subassemblies are attached to the diagonal rib elements of the truss members, to adjacent roof panels, and, for the roof panel subassembly lowest on the roof, to the adjacent wall panel element. End walls may be formed by appropriately placing support columns and attaching wall panel subassemblies thereto, to each other, to the foundation, and to the lower horizontal rib elements of truss members disposed at each end of the structure.

After being so fully framed, the structure may be completed by installing exterior and interior sheeting elements into the clear regions of the wall panel subassemblies, including insulation, if desired, and roof sheeting elements on the clear regions of the roof panel subassemblies. The entire roof area may then be covered, over the roof sheeting elements and panel frames, with conventional roofing materials.

Special features, such as doors and windows, may be, incorporated, as desired, into such a structure by omitting the vertical smaller sheeting support elements from selected clear regions of selected wall panel subassemblies, and, where appropriate for a doorway, a major horizontal divider. Thus, a clear opening to accept a window or door frame is left in the standard wall panel subassembly. Structural bracing to support such a window or door frame may be appropriately included.

Larger doorway openings, such as an overhead door for vehicle access, are accommodated by forming special double nominal width wall panel subassemblies, of a second type, formed of larger tubing elements such that intermediate truss members may rest on such a wall panel subassembly, absent a support column.

Truss members configured for the ends of the structure are fabricated on a special jig such that they are supported directly on the end wall of the structure, and their intermediate riser elements align with vertical frame elements and major vertical divider elements of the wall panels below. No diagonal braces are included but smaller vertical elements are included for the attachment of appropriately cut exterior and interior sheeting.

It is to be noted that the length of the building so fabricated has not been mentioned, however, such structures can be of any length which is a multiple of the eight foot (nominal) wall panel subassembly widths.

BRIEF DESCRIPTION OF THE DRAWINGS

FIG. 9 illustrates a typical double width wall panel subassembly adapted to provide a large opening for vehicle access and the like.

DESCRIPTION OF THE PREFERRED EMBODIMENT

Referring now to FIG, 1, a typical structure utilizing the pre-formed building system described herein is indicated generally at 10. Illustrated, as examples, are a single entrance door 12, several windows 14, 16 and a large, vehicle access door 18. The basic structure is fabricated from a plurality of pre-formed wall panel subassemblies, each nominally eight feet wide and twelve feet tall, a plurality of pre-formed roof panel subassemblies, each nominally eight feet wide and, as appropriate, eight, four or two feet in perpendicular extent, a plurality of pre-formed truss panel subassemblies forming an appropriate number of truss members, and an appropriate plurality of pre-formed support columns. Roofing 20, of conventional type, is shown installed. A near corner of the structure 10 is indicated at 22.

Figure 1:
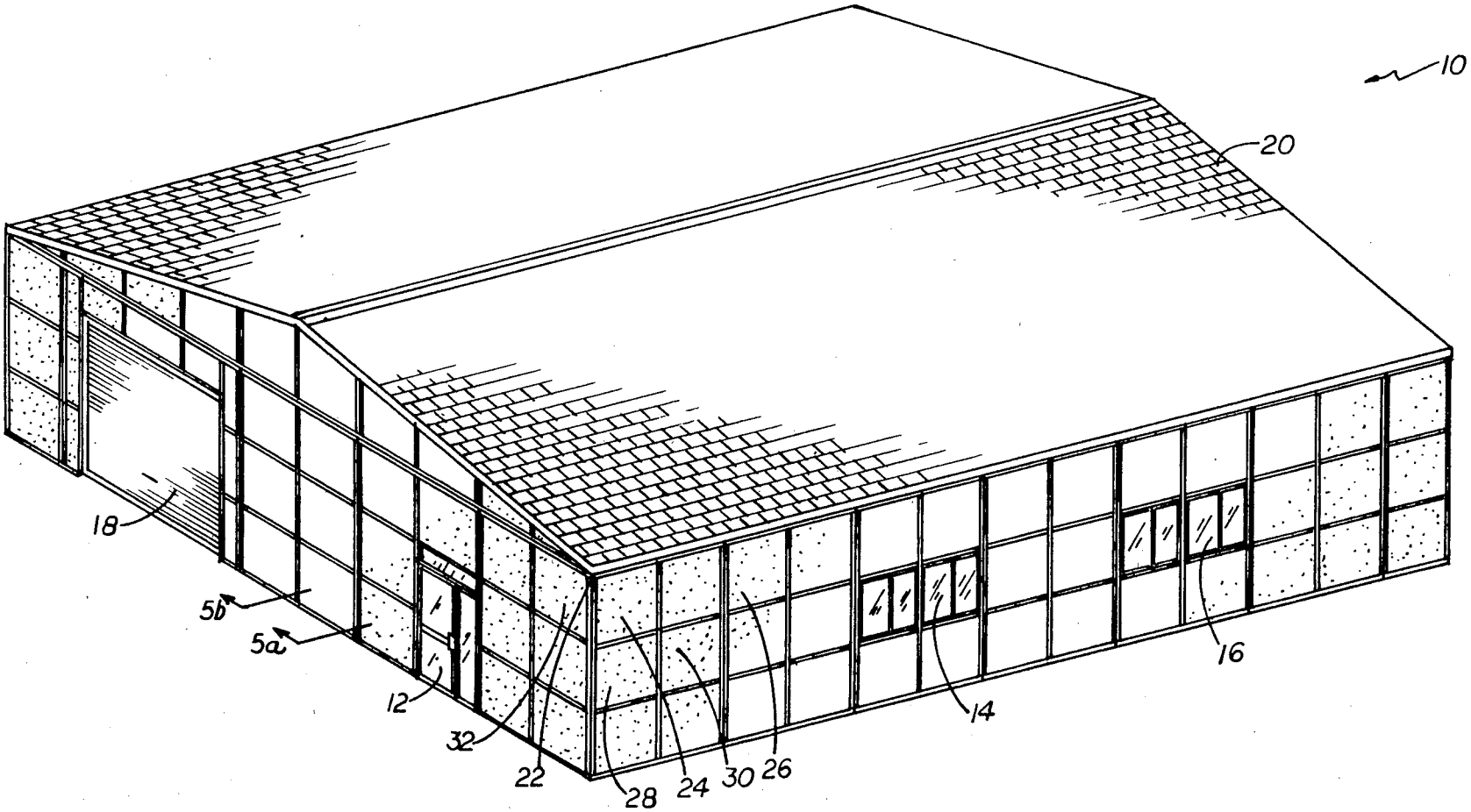
FIG. 1 presents a perspective view of a typical structure constructed in accordance with the present invention.
Figure 2:
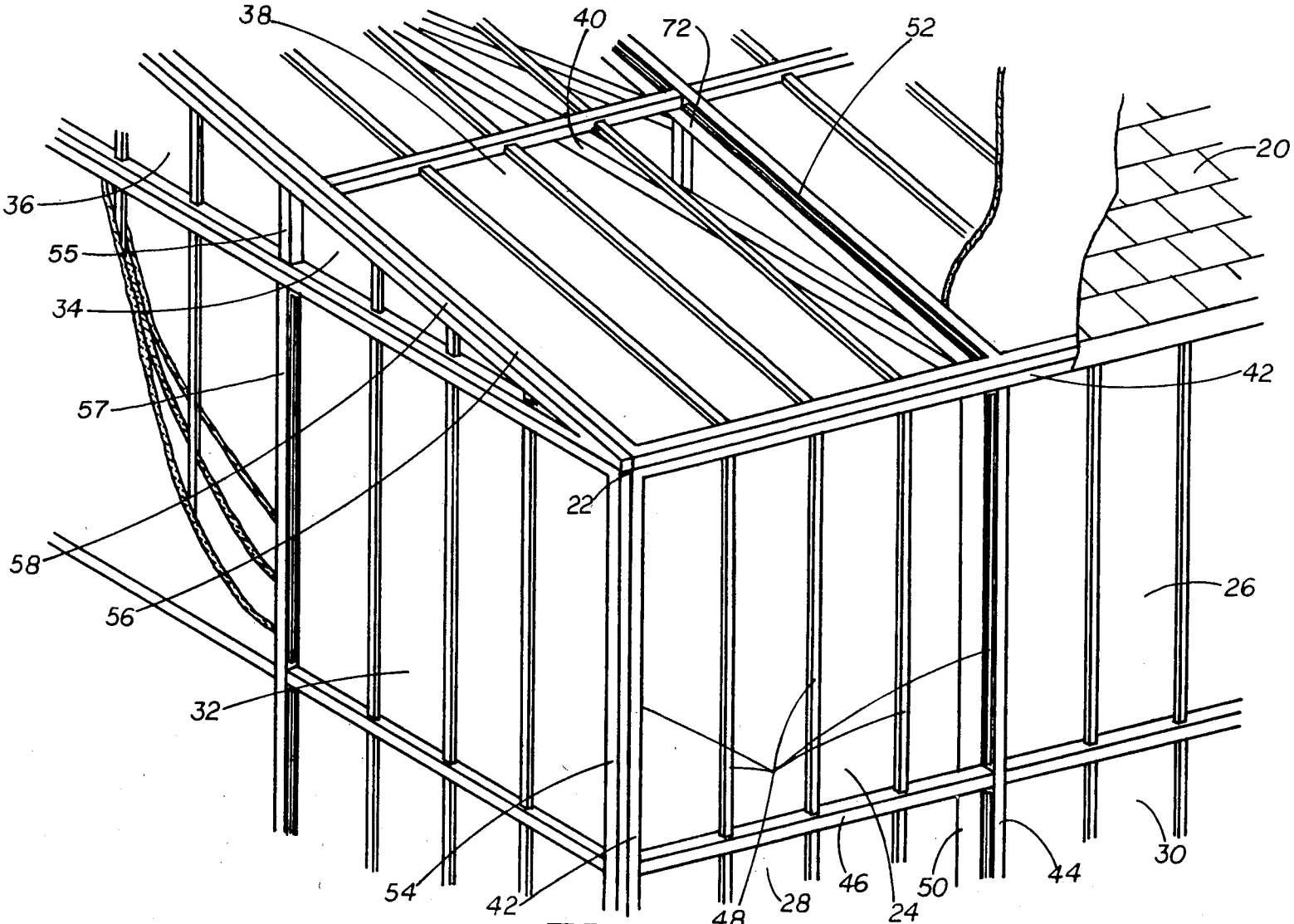
FIG. 2 illustrates a perspective sectional view of the corner of such a structure.

Referring now to FIG. 2, a cut-away segment of the near corner 22 of the structure 10 is illustrated to show, in part, details of the several wall panel, roof panel, and truss panel subassemblies, and support columns and their mode of assembly. A segment of a side wall extending to the right from the corner 22 comprises an upper left sheeting space 24 of a wall panel subassembly, together with portions of an upper right and downwardly sheeting space 26 and two sheeting spaces 28, 30 respectively, immediately below. Several elements of the wall panel subassembly construction are omitted for clarity, but will be addressed in subsequent discussion. Extending to the left and downwardly from the corner 22 is an upper right sheeting space 32 of an end wall panel subassembly, together with portions of those sheeting spaces immediately adjacent thereto.

Extending upwardly left from the corner 22 is a first riser space 34 and a portion of the next adjacent riser space 36 of an end type truss member panel subassembly.

Rising diagonally upward and to the right from the corner 22 is a first sheeting space 38 of a corner roof panel subassembly together with portions of adjacent sheeting spaces.

A first internal truss member 40 of a structural support type is partially illustrated.

Considering first the wall panel subassembly extending to the right from the corner 22, a portion of an external frame element 42 is illustrated. Also shown is a major vertical dividing element 44, a horizontal dividing element 46, and segments of smaller sheeting support elements 48. A single support column 50 for the first truss member 40 is shown directly behind the major vertical dividing element 44.

The manner of construction of the roof panel subassembly and the end wall panel subassembly are noted to be identical to the wall panel subassembly described above. It is to be further noted that a major transverse dividing element 52 of the roof panel subassembly rests on an diagonal rib element 72 of the first internal truss member 40 and is aligned, relative to the end wall of the structure, directly above the major vertical dividing element 44 of the side wall panel subassembly.

In examining the end type truss configuration, it is to be observed that a major riser 55 aligns with a major vertical divider element 57 of the end wall panel frame subassembly 22 on which said truss member rests.

The assembly of the corner 22 of said structure 10 shows that a vertical side of an external frame element 54 of the end wall panel subassembly overlaps the vertically oriented frame element 42 of the first side wall panel subassembly to form a flush surface on the side of the structure. A roof panel subassembly external frame element 56 is shown to be flush with a diagonal rib element 58 of the end type truss panel subassembly. All such conjunctions of major elements are rigidly attached to each other by bolt means, as will be discussed in detail hereinbelow.

Figure 3:
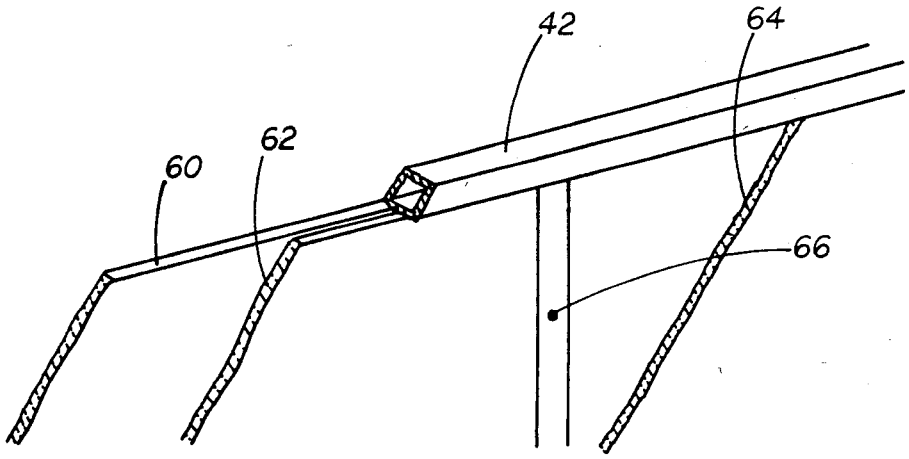
FIG. 3 shows a fragmentary perspective cross-section of a portion of a wall panel subassembly in accordance with the present invention.

Referring now to FIG. 3, the detail of assembly of each of said wall panel subassemblies, after installation as part of the structure, is shown. In fragmentary view, the external frame element 42 is shown near its intersection with one of the sheeting support elements 48. Considering this view to be from the interior of the structure 10, an exterior sheeting element 60 is placed on the far side of the wall panel subassembly and sheeting support element 48 such that its outer surface is flush with the far surface of the frame element 42. The sheeting element. 60 fits entirely within a clear region defined by said frame element 42 and the dividing elements 44, 46. A layer of insulating material 62 may be placed inwardly adjacent to the exterior sheeting element 60. Finally, an interior sheeting element 64 may be placed internally within the clear region of the frame element 42 such that its surface directed inwardly of the structure forms a flush surface with the inwardly directed surface of the frame element 42. Common sheet metal screws are passed through the interior sheeting element 64, through a respective one of a plurality of spaced apart pre-drilled holes 66 in the sheeting support element 48 and into the exterior sheeting element 60.

Each sheeting space 24, 26, 28, 30, 32, etc. of the end and side wall panel subassemblies are enclosed with exterior and interior sheeting elements as described, except in such areas as are reserved for doors or windows. Said sheeting is installed after the panel subassemblies are assembled into a structure 10.

Figure 4:
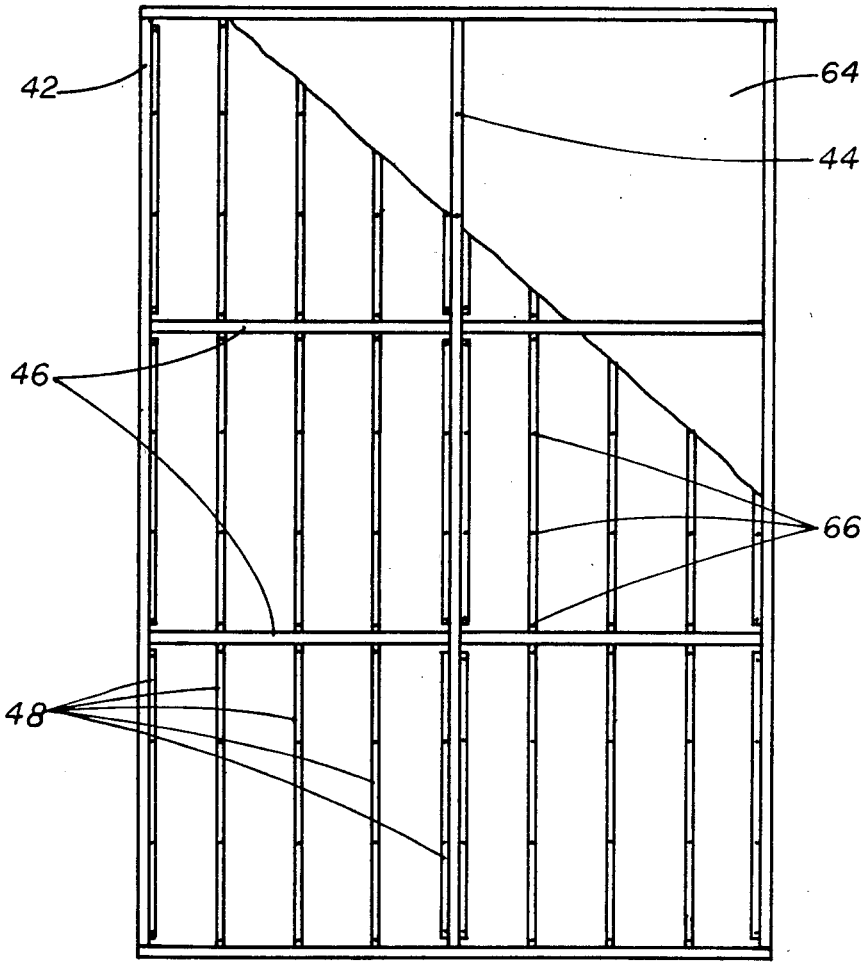
FIG. 4 illustrates a wall panel subassembly in accordance with the present invention.

Referring now to FIG. 4, a typical wall panel subassembly is illustrated to identify the placement of its several elements. Surrounding the entire wall panel subassembly is the external frame member 42, formed of a square or rectangular cross-sectional tubular stock. The embodiment shown within FIG. 4 represens a wall panel subassembly having nominal dimensions of eight feet in width and twelve feet in elevation. Considering one of the shorter sides as the bottom of said wall panel subassembly, the vertical major dividing element 44 is rigidly affixed, preferably by welding means, to extend between the upper and the lower end segments of the external frame element 42 such that it is located midway between the two vertical sides of the external frame element 42. In fabrication, the horizontal dimension between an inner surface of a vertical side of the external frame element 42 and the first proximate surface of the major vertical dividing element 44 is maintained to be four feet plus one-sixteenth inch for sheeting material irregularities. An identical dimension obtains for the other half of a horizontal traverse. Said major vertical dividing element 44 is of the same tubular stock as is the external frame element 42.

In the illustrated example, two horizontal dividing elements 46 are disposed to extend between the two vertical sides of the external frame element 42 and, intersecting with the major vertical dividing element 44. Said horizontal dividing elements 46 are rigidly affixed, preferably by welding means, to the vertical sides of the external frame element 42 and to the major vertical dividing element 44 at all points of intersection. Said horizontal dividing elements 46 are equally spaced apart in elevation with respect to the upper and lower end segments of the external frame element 42 such that vertical clear spaces between proximate surfaces of such elements are maintained, during fabrication, to be four feet plus one-sixteenth inch for sheeting irregularities. Said horizontal dividing elements 46 are of the same tubular stock as the external frame element 42.

A plurality of sheeting support elements 48 are disposed to extend vertically through each clear space bounded by the external frame element 42 and the vertical and horizontal dividing elements 44, 46 respectively. Considering one of the clear spaces for illustration, one of such sheeting support elements 48 is rigidly affixed, preferably by welding means, along its length, to the inner surface of a vertical side of the external frame element 42. A second such sheeting support element is rigidly affixed in a like manner to the first surface of the major vertical dividing element 44. In the preferred embodiment, three additional sheeting support elements 48 are equidistantly disposed and rigidly affixed to the horizontal elements at their respective intersections such that, in all cases, said sheeting support elements 48 are substantially twelve inches apart on centers.

Each of said sheeting support elements 48 contains a plurality of pre-drilled holes 66, nominally on sixteen inch centers, as common to the building trades, said holes 66 being present for the attachment of the exterior and interior sheeting. A portion of such interior sheeting elements 64 is illustrated in FIG. 4.

Other pre-formed wall panel frames subassemblies, each based on multiples of nominally four foot by four foot clear areas are envisioned for structures of varying sizes and elevations. Nominal total elevations may be eight, ten, twelve, fifteen, or sixteen feet. Nominal total widths are four or eight feet. It is to be noted that the ten and fifteen foot nominal total elevations require the use of five foot nominal vertical dimension clear spaces and utilize half sheets of standard ten foot sheeting.

Roof panel subassemblies are similarly prefabricated but are of a nominal eight foot by eight foot size. Eight foot by four foot and eight foot by two foot roof panel subassemblies are also envisioned. Only exterior sheeting is necessary to provide a base for standard roofing materials.

Figure 5:
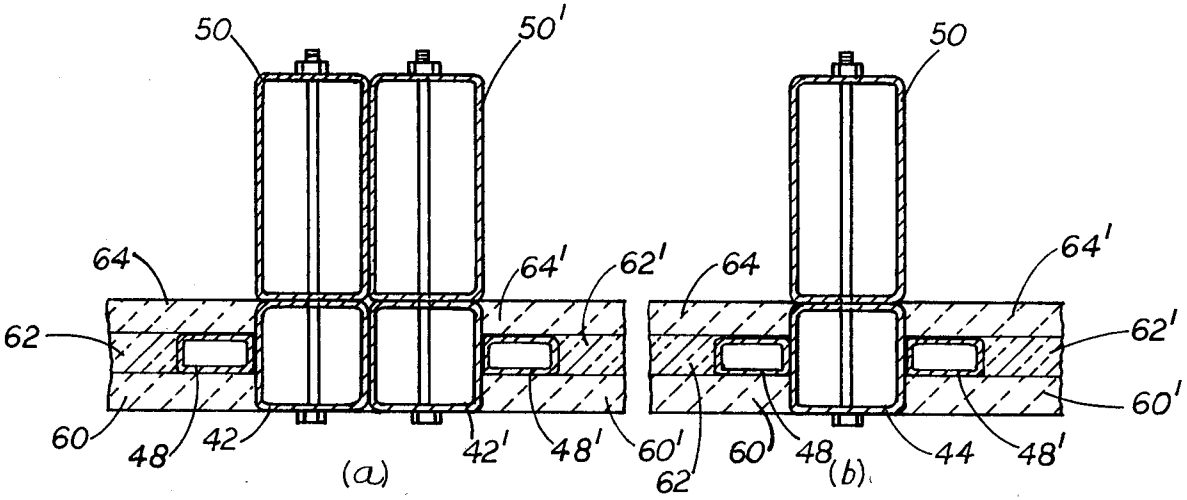
FIG. 5 illustrates the assembly detail, in plan view cross-section, of a wall panel subassembly elements to a support columns.
Figure 6:
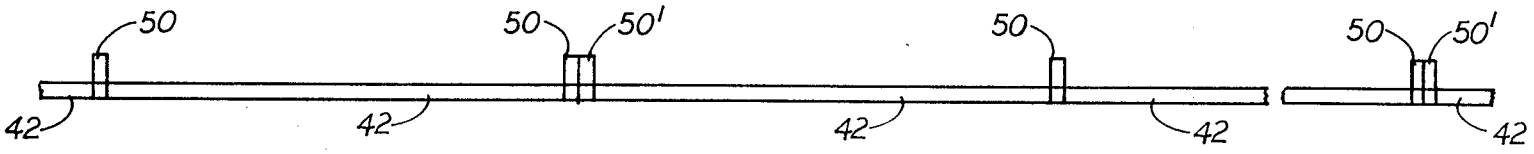
FIG. 6 presents a partial plan view of support column placements.

Referring now to FIGS. 5 and 6, the method of supporting said wall panel subassemblies is introduced. Where two wall panel subassemblies 42, 42'40 abut, in a horizontal direction, two support columns 50, 50' are situated internal to the structure. Bolt means, passing through from the exterior of the structure, through the wall panel frame elements 42, 42' thence through the support columns 50, 50', are typically employed. In elevation, a plurality of such bolt means are introduced for rigidity and structural integrity. FIG. 5(*a*) illustrates such a double support column installation.

At the midpoints of each of the wall panel subassemblies, whereat the major vertical dividing element 44 is located, a single support column 50 is situated and to which the wall panel major vertical dividing element 44 is affixed, by a plurality of bolt means, as shown in FIG. 5(*b*). In a complete structure, therefore, as shown in FIG. 6, the wall panel subassemblies are alternately attached to a single support column 50 or to double columns 50, 50' as the length of the wall is traversed. Adjacent wall panel subassemblies are joined together by a plurality of bolt means, passing through the abutting vertical sides of the adjacent external frame members 42, 42' parallel to the plane of FIG. 5(*a*) but normal to the direction of the illustrated bolt means. In those areas wherein such wall panel subassembly linking bolt means are disposed, a portion of the affixed sheeting support element 48 may be omitted for clearance.

Figure 7:
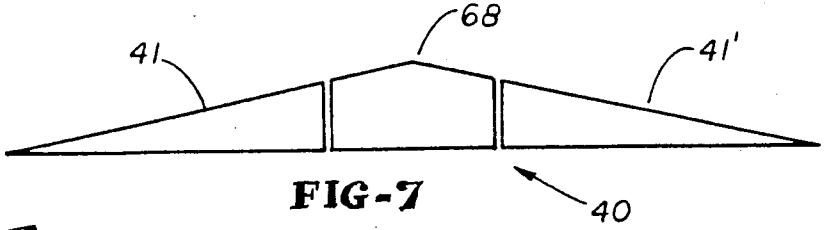
FIG. 7 is a schematic presentation of a truss member in accordance with the present invention.
Figure 8A:
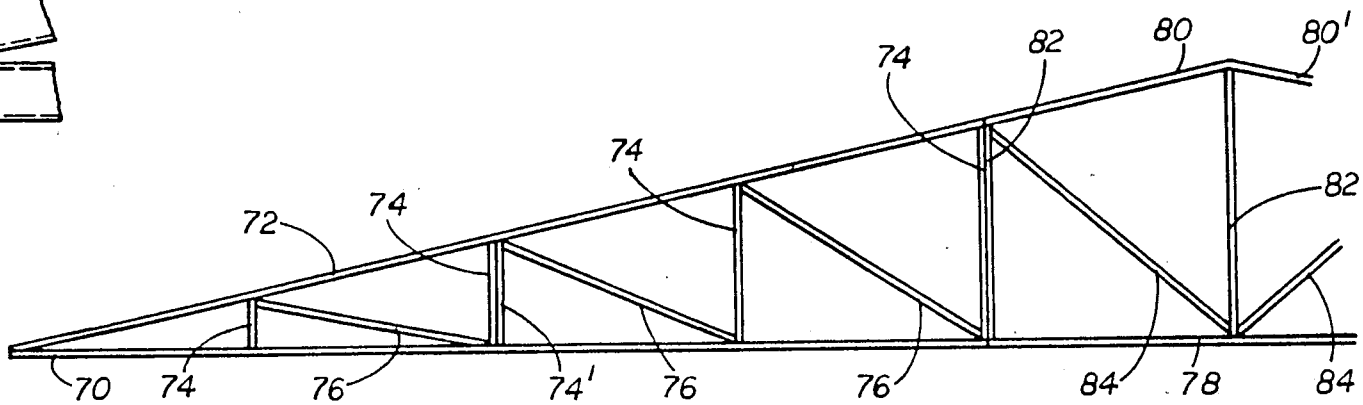
FIG. 8 shows details of truss panel subassembly construction and assembly.
Figure 8B:
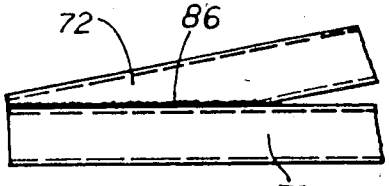
Figure 8C:
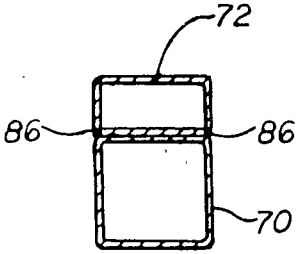

Referring now to FIGS. 7 and 8, it can be seen that a typical roof truss member 40 comprises two first truss panel subassemblies 41, 41', of a first type, placed so as to form left and right ends of the truss member 40, which includes a central truss panel subassembly 68. Each first truss panel subassembly 41 is prefabricated, for illustration, into a nominally sixteen foot length. A lower horizontal rib element 70 provides the major load bearing structure. To one end of said horizontal rib element 70 is rigidly affixed the end of a diagonal rib element 72. The diagonal rib element 72 has one end truncated so as to form an angle and surfaces of contact with an upper surface of the horizontal rib element 70, as shown in FIG. 8(*b*). The angle truncation of the diagonal rib element 72 is pre-formed to provide the desired pitch or slope angle of the roof of the structure. A weld 86 forms the fundamental means of joining the diagonal rib element 72 to the horizontal rib element 70 at the region of intersection. Vertical riser elements 74 of appropriate vertical extent are disposed between and rigidly affixed to the horizontal rib element 70 and the diagonal rib element 72, with their horizontal displacements from the lowest point of the diagonal rib element 72 being such that, when assembled in the structure 10, said riser elements 74 align with major vertical dividing elements 44 and each vertical side of an external frame element 42 of an end wall panel subassembly placed directly below said truss panel subassembly 41. It is to be noted that the second riser element 74 from lowest point of the diagonal rib element 72 is, in reality, a double riser element to provide appropriate horizontal spacings considering the abutting of adjacent wall panel subassemblies.

Bracing diagonal elements 76 are disposed between and rigidly affixed to adjacent riser elements 74 to provide additional structural integrity.

A central truss panel subassembly 68, of a second type, forms part of the preferred embodiment, and is, for illustration, nominally eight feet in length. It incorporates a unitary horizontal rib element 78 and a pair of diagonal rib elements 80,. 80' separated from the horizontal rib element 78 by and rigidly affixed to vertical riser elements 82. The dimensions of said riser elements are such that when the horizontal rib element 78 is disposed so as to be an abutting continuation of the horizontal rib element 70 of the first truss panel subassembly 41, one of the diagonal rib elements 80, disposed above the end of the horizontal rib element 78 in abutting contact with the adjacent first truss panel subassembly 41, forms a continuation of the diagonal rib element 72 of the first truss panel subassembly 41. Bracing diagonal elements 84, 84' are disposed between and rigidly affixed to said riser elements 82 for structural integrity.

The second diagonal rib element 80' of the central truss panel subassembly 68 assumes a reversed angle so as to form the pitch angle of the other half of the roof surface.

In alternate embodiments, the central truss panel subassembly 68 may be omitted to form a structure of lesser span. Alternate lengths of the truss members are also envisioned to provide a discrete variety of structure widths. Spans of eight, twelve and sixteen feet for the first truss members panel subassemblies 41, and of four, eight, twelve, and sixteen feet for the central truss panel subassembly 68, are available which, in appropriate combination, may provide structure spans of between nominally sixteen and forty-eight feet, in four foot increments.

It is recognized that the roof panel subassemblies of nominally eight feet by eight feet dimensions will be placed along the diagonal rib elements of the truss members and that such dimensions will not directly match with the riser locations. However, since generally the slope of the roof of the preferred embodiment is relatively shallow, such error is acceptable. As will be discussed more fully hereinbelow, the roof panel subassemblies are attached to a diagonal rib element of the truss members through through their "side" frame elements and through their major "vertical" dividing elements. No horizontal members are disposed to extend between truss members, thus no attachments are provided for roof panel subassemblies in a direction along the length of the structure, except as previously described.

Referring again to FIG. 4, where architectural design of the structure 10 dictates that a window should be placed, the sheeting support elements 48 are omitted from a desired clear region during fabrication of such a wall panel subassembly. If the window is to be wider than four feet, the major vertical dividing element 44 is also omitted in that portion of the wall panel subassembly. A standard window frame may then be incorporated and integrated by appropriate bracing into the clear area provided.

Where the architectural design dictates a doorway, an appropriate clear area may be provided by omitting the sheeting support elements 48 and a lower horizontal dividing element 46 from the wall desired panel subassembly during fabrication.

Figure 9A:
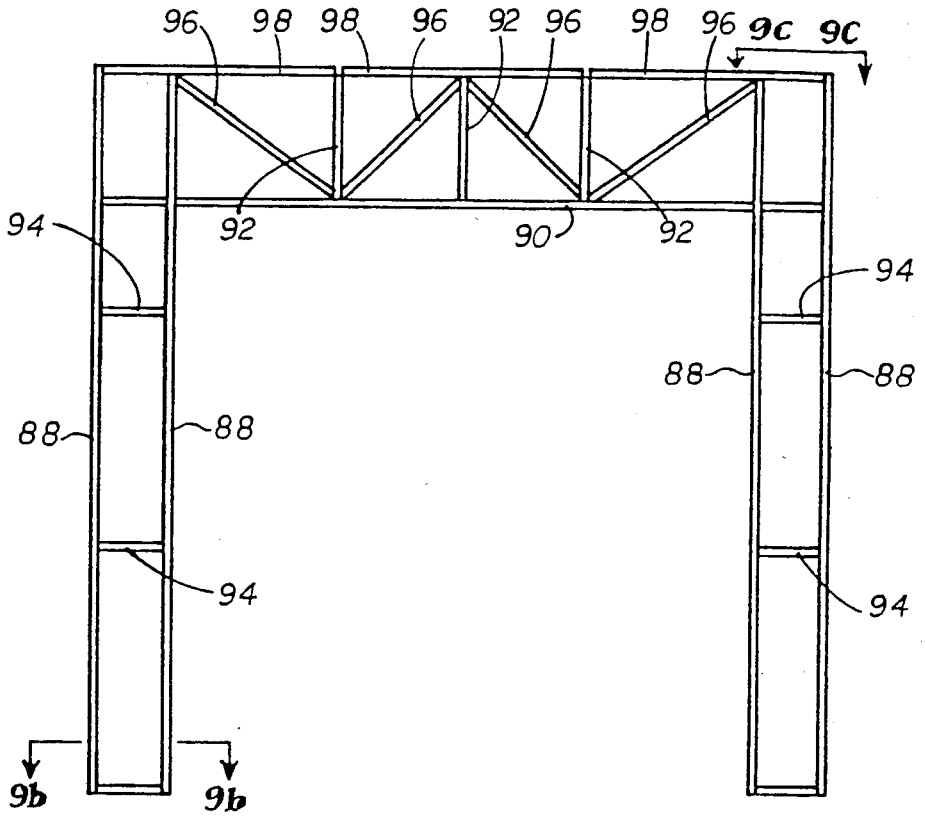
Figure 9B:
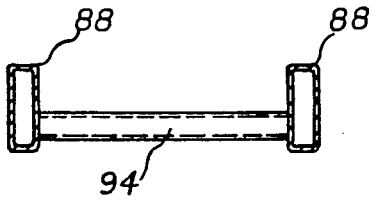
Figure 9C:
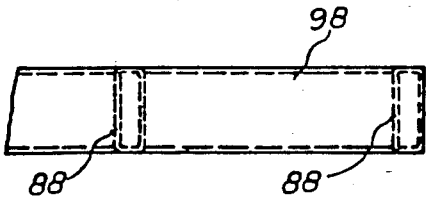

Referring now to FIG. 9, in those applications wherein a large entryway, such as a vehicle entrance, is required, a special composite wall panel subassembly may be fabricated. In the illustration forming the principal embodiment, such a doorway, to provide a nominally ten foot by ten foot clear aperture is envisioned. As shown in the cross-sections of FIGS. 9(*b*) and 9(*c*), the tubular material used for such a special panel subassembly has a rectangular form and has a depth, external to internal of the structure, equivalent to the combined dimension of a frame element 42 and a support column 50 as shown in FIG. 5.

Such a special wall panel subassembly is comprised of two pairs of vertical sides 88 disposed vertically, the inner proximate one of each pair joined rigidly by a horizontal rib element 90, which, in turn, supports dividing vertical riser elements 92. The upper ends of said vertical sides 88 and said vertical riser elements 92 are rigidly joined by horizontal top brace elements 98. Horizontal dividing elements 94 are included for uniformity of external appearance of the structure. Bracing diagonal elements 96 are disposed between and rigidly affixed to the vertical sides 88 and the vertical riser elements 92 for structural integrity. It is to be noted that the horizontal top brace elements 98 do not form a continuous rib across the top of said panel, but, rather, include gaps at those vertical riser element 92 locations whereat roof truss member placements would arise if such a doorway were located in a side wall of the structure 10.

Figure 10:
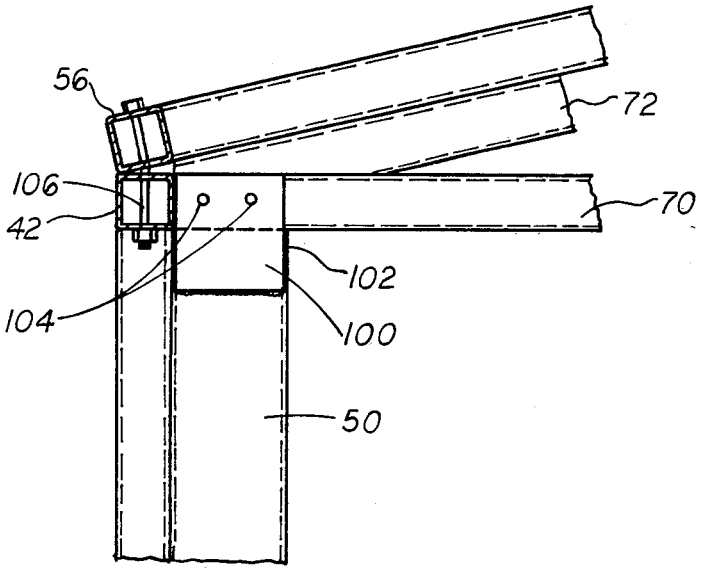
FIG. 10 is a partial detail showing a manner of attachment of a truss member to its support column, a roof panel subassembly to a wall panel subassembly and the truss member, and the wall panel subassembly to the support column.

Referring now to FIG. 10, the manner of assembly of a support column 50, truss member 40, wall panel frame element 42, and roof panel subassembly are illustrated in detail. The upper end of said support column 50 has affixed, preferably by weld means 102, a saddle 100, of a first type adapted to be attached to a single support column, which provides a situs wherein the extremity of the truss member 40 is received. Said truss member 40 rests solely upon said support column 50 and is rigidly affixed thereto by bolt means 104 passing through said saddle 100 and through the horizontal rib element 70 of the truss member 40. Similar supporting and retaining means prevail at the opposite ends of each such truss member. Where the truss member 40 is to span the structure 10 between abutting pairs of columns forming a double column at opposite sides of the structure, the saddle 100 is a second type adapted to be attached to such a double column so as to support a single truss member. The upper horizontal wall panel frame element 42, being affixed by horizontal bolt means to the support column 50, achieves an elevation substantially equal to that of the upper surface of the said horizontal rib element 70. The lowest of the roof panel subassemblies extends diagonally downward along and upon the diagonal truss rib element 72 of the first member 40 such that its lowermost end member extending longitudinally of the structure overlaps the upper surface of the wall panel frame element 42, to which it is rigidly affixed by bolt means 106. It is to be observed that said bolt means 106 may be intentionally bent, to enable uniform hole drilling during fabrication. Additional bolt means are provided to rigidly affix said roof panel subassembly to the diagonal rib element 72 of the supporting truss member.

Figure 11:
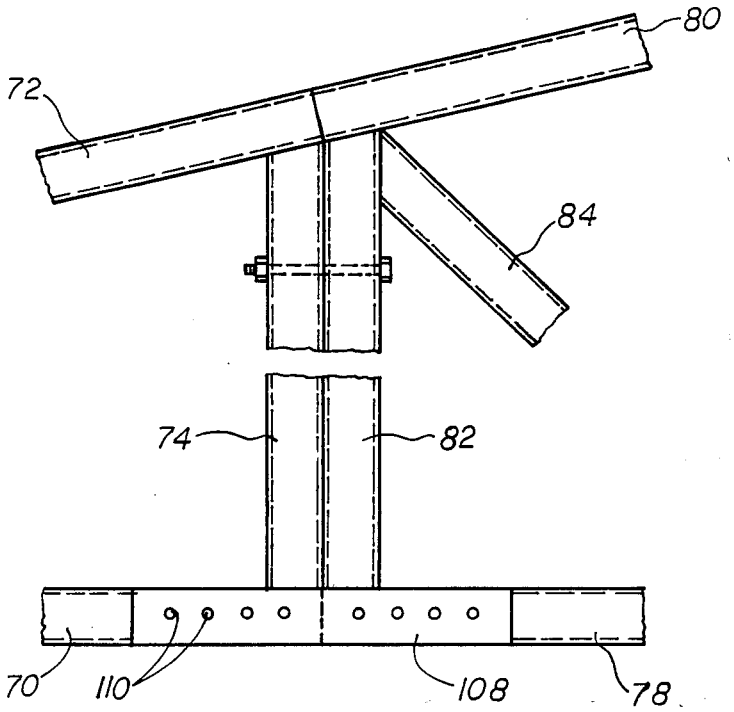
FIG. 11 is a partial detail of a junction whereat truss panel subassemblies forming a member are joined.

Referring now to FIG. 11, wherein the joint between the first truss panel subassembly 41 and the central truss panel subassembly 68 is shown, the nature of the geometry of the integrated structure is such that roof forces directed downward upon the diagonal rib elements 72 and 80 are translated into a bending force on the truss member such that the horizontal rib elements 70 and 78 would tend to move apart in a generally horizontal and downward direction unless restrained. For that purpose, at each such joint, a truss plate 108 is attached to both sides of the horizontal ribs 70, 78 by bolt means 110, thereby forming a continuous horizontal rib element traversing the span of the structure 10. Additional horizontal bolt means may be introduced between the adjacent abutting riser elements 74, 82 to provide additional structural integrity.

Throughout the above description of the several elements comprising the herein pre-formed building system, this applicant has referred to a particular size structure as his principal embodiment. This applicant submits that the concepts herein set forth are not limited to size of the elements or components, but rather, are applicable in a variety of dimensional cases. Moreover, it is this applicant's contention that all elements stated hereinabove as part of his concept are essential in that the integral nature of the structure envisioned is one of its prime characteristics.

For those and all other embodiments suggested or disclosed by the above descriptions,

I claim:

1. A pre-formed building system, for erection of a structure on a prepared foundation, comprising:

a plurality of support columns, disposed in a spaced apart relationship about the periphery of said foundation so as to be abuttingly aligned with internal surfaces of a pair of side walls and a pair of end walls, respectively, each support column being vertically oriented to rest on and to be anchored to said foundation, the spacing between said support columns being such that a single support column is situated substantially at each corner of the structure, a second single support column is situated a first spacing distance from the first support column in each horizontal direction from each corner toward each peripherally adjacent corner of the structure, a third single support column is situated a first spacing distance from the second support column in each horizontal direction progressing away from each corner, a fourth single support column is situated so as to abut with the third support column along their respective vertical edges in a direction progressing away from each corner column so as to form a double column, and said remaining support columns are situated as alternatingly single columns and abutting pairs so spaced along each half-extent of each of the side and end walls, such that an integer number of single support columns and an integer number of abutting pairs of support columns traverse the extent of each wall of the structure;

a plurality of saddles of a first type, said plurality of saddles of the first type being rigidly affixed to, respectively, an uppermost end of each of said single support columns of the side walls of the structure excluding each corner support column;

a plurality of saddles of a second type, said plurality of saddles of the second type being rigidly affixed to, respectively, uppermost ends of each of said abutting pairs of support columns of the side walls of the structure;

a plurality of pre-fabricated wall panel subassemblies, each of said subassemblies comprising a substantially rectangular external frame element, formed of a rigid rectangular tubing material, a major vertical dividing element, at least one horizontal dividing element, and a plurality of sheeting support elements, wherein said external frame element has two vertical sides disposed in a parallel spaced apart relationship so as to be separated by substantially twice said first spacing distance, with an upper end segment and a lower end segment completing said rectangle, said major vertical dividing element being affixed to and extending between said upper and said lower end segments so as to be parallel to and equidistant from said sides, said major vertical dividing element being formed of tubular stock having a rectangular cross-section of the same dimensions as said external frame element, said at least one horizontal dividing element, formed of identical rectangular tubular material as said external frame element, being disposed to extend between and to be affixed to said sides of said external frame element and said major vertical dividing element so as to be parallel with said upper and said lower end segments of said external frame element such that the spacing between the upper end segment of the external frame element and the adjacent horizontal dividing element is substantially identical with the spacing between the lower end segment of the external frame element and the horizontal dividing element proximate thereto and with the spacing between adjacent horizontal dividing elements, said plurality of sheeting support elements being disposed in a vertical orientation between each of said horizontal dividing elements and between said horizontal dividing elements and said upper and said lower end segments of said external frame element, said sheeting support elements being spaced apart in a horizontal direction such that a respective one of said sheeting support elements is in parallel abutting contact with each of said sides of said external frame element, a respective one of said sheeting support elements is in parallel abutting contact with each side of said major vertical dividing element, and remaining sheeting support elements are parallelly spaced apart by substantially equal distances;

a plurality of roof panel subassemblies each roof panel subassembly comprising an external frame element, formed of a substantially rectangular tubular material, having a pair of transverse side members, parallelly spaced apart by substantially twice said first spacing distance, and a pair of longitudinal end members spaced apart by substantially twice said first spacing distance, a major transverse dividing element disposed parallelly equidistant between said transverse side members and rigidly affixed to and extending between said longitudinal end members, a pair of longitudinal dividing elements disposed along a line parallelly equidistant from said longitudinal end members and each rigidly affixed to and extending between one of said transverse side members, respectively, and said major transverse dividing element, and a plurality of sheeting support elements disposed in equidistant spaced apart relationship with each other so as to be parallel with said transverse side members and said major transverse dividing element such that a respective one of said sheeting support elements is in parallelly abutting contact with each of said transverse side members and with each side of said major transverse dividing element, each of said sheeting support elements being rigidly affixed to and extending between said longitudinal end members and said longitudinal dividing elements;

a plurality of truss panel subassemblies of a first type, formed of rectangular tubing material, wherein each truss panel subassembly of the first type comprises a lower horizontal rib element having a horizontal extent substantially equivalent to an integer multiple of wall panel subassembly horizontal widths, a diagonal rib element, rigidly affixed at one end thereof to one end of said lower horizontal rib element, and forming a roof slope angle therewith, a plurality of vertical riser elements, rigidly affixed between said lower horizontal rib element and said diagonal rib element in a spaced apart relationship such that an abutting pair of vertical riser elements are situated at each even multiple of said first spacing distance from the point of intersection of said lower horizontal rib element and said diagonal rib element, and a single vertical riser element is disposed at each odd multiple of said first spacing distance, except that the vertical riser element disposed at the end of said lower horizontal rib element farthest removed from said point of intersection shall be a single vertical riser element, and a plurality of bracing diagonal elements rigidly affixed to each vertical riser element and said lower horizontal rib element at their point of intersection and extending to be rigidly affixed to the next shorter vertical riser element and the diagonal rib element at their point of intersection;

each of said support columns, said saddles of the first and second types, said wall panel subassemblies, said roof panel subassemblies, and said truss panel subassemblies having a plurality of interconnection holes formed therein at predetermined locations;

means for connecting said wall panel subassemblies to respective inwardly adjacent support columns through each vertical side of each external frame element and through each major vertical dividing element of each wall panel subassembly;

means for connecting each wall panel subassembly to the adjoining wall panel subassemblies through the abutting vertical sides of the external frame elements;

means for coupling together pairs of said plurality of truss panel subassemblies of the first type to form a plurality of truss members wherein the longest of the vertical riser elements of each of the pair of truss panel subassemblies of the first type are placed in parallel abutting contact to form a planar triangular truss member such that the lower horizontal rib elements of the pair of truss panel subassemblies of the first type are substantially colinear;

means for coupling said truss members to said saddles of the first and second types such that said truss members span said structure transverse to its extent and are parallelly spaced apart with respect to an end wall of said structure, each of said support columns or pair of support columns and its transversely opposite support column or pair of support columns supporting one of said truss members;

means for connecting said roof panel subassemblies to the diagonal rib elements of said truss members through the transverse side members and the major transverse dividing element of each roof panel subassembly;

means for connecting each of said roof panel subassemblies situated so as to have a longitudinal end member disposed substantially adjacent an upper end segment of the external frame element of a wall panel subassembly, to said wall panel external frame element through said longitudinal end member of the roof panel subassembly and said upper end segment of the wall panel external frame element;

means for connecting each transverse side member of said roof panel frame element to the abutting transverse side members of adjacent roof panel subassemblies;

means for connecting abutting longitudinal end members of adjacent roof panel subassemblies;

a plurality of external wall panel sheeting elements, each of said wall panel sheeting elements being configured as a planar rectangle having dimensions substantially equal to, but less than, the internal distance within a wall panel subassembly separating the surfaces of a vertical side of the external frame element and the major vertical dividing element in a horizontal direction and between adjacent end segments and horizontal dividing elements in a vertical direction;

means for connecting said wall panel sheeting elements to said wall panel subassemblies through said sheeting support elements;

a plurality of roof panel sheeting elements, each of said roof panel sheeting elements being configured as a planar rectangle having dimensions substantially equal to, but less than, the internal distances within a roof panel subassembly separating the surfaces of the external frame element and the transverse and longitudinal dividing elements of the roof panel subassembly;

means for connecting the roof panel sheeting elements to the roof panel subassemblies through the sheeting support elements; and standard roofing materials sufficient to overlay said plurality of roof panel subassemblies.

2. A pre-formed building system as claimed in claim 1, further comprising:

a plurality of interior wall panel sheeting elements, each of said interior sheeting elements being configured as a planar rectangle having dimensions substantially equivalent to each of said exterior wall panel sheeting elements;

wherein said means for connecting said exterior wall panel sheeting elements to said wall panel subassemblies are adapted so as to connect both said interior wall panel sheeting elements and said exterior wall panel sheeting elements to said wall panel subassemblies through said vertical sheeting support elements.

3. A pre-formed building system as claimed in claim 2, further comprising:

a plurality of volumes of insulating material, each of said volumes of insulating material being appropriately configured to be contained within a rectangular cylindrical volume within a wall panel subassembly bounded by the inner surface of an exterior wall panel sheeting element and the proximate surface of the corresponding interior wall panel sheeting element.

4. A pre-formed building system as claimed in claim 1, wherein at least one of said exterior wall panel sheeting elements and its supporting vertical sheeting support elements are configured as a window frame adapted to retain a planar transparent pane.

5. A pre-formed building system as claimed in claim 2, wherein at least one of said exterior wall panel sheeting elements, its corresponding interior wall panel sheeting element, and their vertical sheeting support elements are configured as a window frame adapted to retain a transparent pane.

6. A pre-formed building system as claimed in claim 3, wherein at least one of said exterior wall panel sheeting elements, its corresponding interior wall panel sheeting element, its corresponding volume of insulating material, and their vertical sheeting support elements are configured as a window frame adapted to retain a transparent pane.

7. A pre-formed building system as claimed in claim 1, further comprising:

at least one wall panel subassembly having a pair of vertical sides parallelly spaced apart by substantially twice said first spacing distance, an upper end segment rigidly affixed to, and spanning the separation between said vertical sides, a major vertical dividing element affixed to said upper end segment and depending therefrom so as to be parallelly equidistant between said vertical sides, a lower end segment rigidly affixed to and spanning the distance between said major vertical dividing element and one of said vertical sides, at least one horizontal dividing element disposed between, and affixed to said major vertical dividing element and said vertical sides, and a plurality of vertical sheeting support elements; and a standardly constructed door frame;

wherein said door frame is connected to one of said vertical sides and said major vertical dividing element so as to provide a clear entry aperture through said wall panel subassembly.

8. A pre-formed building system as claimed in claim 1, further comprising:

at least one wall panel subassembly formed of two pairs of parallelly spaced apart vertical sides having a vertical extent substantially equal to that of other wall panel subassemblies of the structure, said two pairs of spaced apart vertical sides being disposed to be coplanar such that a horizontal spacing between the outermost of said vertical sides of each pair is substantially four times said first spacing distance and the spacing between the innermost vertical sides of each pair provides a desired horizontal aperture distance, a pair of lower end segments rigidly affixed to and spanning the separation between the outermost and innermost vertical sides of each pair, respectively, a horizontal rib element rigidly affixed to and spanning the separation between the innermost vertical sides of each pair at an elevation providing a desired vertical aperture distance, a plurality of foreshortened horizontal dividing elements rigidly affixed to and disposed between the innermost and outermost vertical sides of each pair at elevations substantially equivalent to elevations of horizontal dividing elements of other wall panels subassemblies of the structure, vertical riser elements rigidly affixed to and extending upward from said horizontal rib element so as to be spaced apart, with respect to the outermost vertical sides by said first spacing distance, a plurality of horizontal top brace elements rigidly affixed to and spanning the distance between each outermost vertical side and its proximate vertical riser element, and between adjacent vertical riser elements, said intersections of said top brace elements and said riser elements being formed to include a recess for receiving one of said truss members, and a plurality of diagonal bracing elements rigidly affixed on the diagonals of rectangles formed by the horizontal rib element, the top brace elements, the outermost vertical sides, and the vertical riser elements;

whereby said wall panel subassembly may be incorporated in said structure in an area of a wall wherein adjacent support columns are separated by four of said first spacing distances so as to provide vehicle access to said structure through said aperture.

9. A pre-formed system as claimed in claim 1, further comprising:

a plurality of truss panel subassemblies of a second type, each of said truss panel subassemblies of the second type being formed to have a horizontal rib element having an extent substantially equivalent to an even integer multiple of said first spacing distance, a plurality of vertical riser elements rigidly affixed to and extending upwardly of said horizontal rib element in a spaced apart relationship such that at least one of said riser elements is situated at each end of said horizontal rib element and at spacings horizontally separated by said first spacing distance, with each even integer multiple of said first spacing distance, except for either end of said horizontal rib element, having two of said riser elements in parallel abutting contact, a pair of diagonal rib elements resting on and affixed to the upper ends of the riser elements, said riser elements located at each end of said horizontal rib element having a vertical extent substantially equivalent to the vertical extent of the longest vertical riser element of a truss panel subassembly of the first type, the centrally disposed vertical riser elements having increasing extent such that said diagonal rib elements are disposed at upwardly intersecting angles, with respect to said horizontal rib element, equivalent to the angle formed by the lower horizontal rib element and the diagonal rib element of the truss panel subassembly of the first type, and said truss panel subassemblies of the second type including a plurality of diagonal bracing elements;

a plurality of truss plates;

means for connecting the outermost vertical riser elements of a truss panel subassembly of the second type with the longest vertical riser elements of two of the truss panel subassemblies of the first type, one of said truss panel subassemblies of the first type being disposed to either side of said truss panel subassembly of the second type; and means for coupling a pair of said truss plates to the horizontal rib element of the truss panel subassembly of the second type and to the lower horizontal rib element of the the abutting truss panel subassembly of the first type so as to span the continuous line thereof at each point of abutting contact.

* * * * *